US008303060B2

(12) United States Patent
Nemoto et al.

(10) Patent No.: US 8,303,060 B2
(45) Date of Patent: Nov. 6, 2012

(54) IMAGE FORMING APPARATUS

(75) Inventors: Yusuke Nemoto, Miyagi (JP); Masanori Takahashi, Miyagi (JP); Daisuke Hasebe, Miyagi (JP); Yukihiro Asano, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 363 days.

(21) Appl. No.: 12/651,635

(22) Filed: Jan. 4, 2010

(65) Prior Publication Data

US 2010/0182370 A1 Jul. 22, 2010

(30) Foreign Application Priority Data

Jan. 16, 2009 (JP) ..... 2009-007285

(51) Int. Cl.
*B41J 29/38* (2006.01)

(52) U.S. Cl. ..... 347/6

(58) Field of Classification Search ..... None
See application file for complete search history.

(56) References Cited

U.S. PATENT DOCUMENTS

2006/0250436 A1* 11/2006 Harada et al. ..... 347/22
2009/0179928 A1 7/2009 Nemoto et al.

FOREIGN PATENT DOCUMENTS

JP 2005-225163 8/2005

OTHER PUBLICATIONS

Derwent document for JP 2005-225163 A.*
Machine translation of JP 2005-225163 A.*
Translation of JP 2005-225163 A.*

* cited by examiner

*Primary Examiner* — Matthew Luu
*Assistant Examiner* — Justin Seo
(74) *Attorney, Agent, or Firm* — Cooper & Dunham LLP

(57) ABSTRACT

An image forming apparatus includes a suction unit; a pressure unit configured to pressurize the inside of a supply channel extending from a liquid container to a recording head at a pressurizing position along the supply channel; an opening and closing unit configured to open and close the supply channel at a position downstream of the pressurizing position; and a control unit configured to cap a nozzle surface with a cap and suction ink from nozzles with the suction unit, to move the cap away from the nozzle surface after pressurizing the inside of the supply channel with the pressure unit to a pressure greater than or equal to atmospheric pressure, to wipe the nozzle surface with a wiping part after closing the supply channel with the opening and closing unit, and to open the supply channel with the opening and closing unit after wiping the nozzle surface.

4 Claims, 9 Drawing Sheets

IMAGE FORMING APPARATUS

BACKGROUND OF THE INVENTION

1. Field of the Invention

The present invention generally relates to an image forming apparatus. More particularly, a certain aspect of the present invention relates to an image forming apparatus including a recording head for jetting liquid droplets.

2. Description of the Related Art

A liquid-jet image forming apparatus such as an inkjet recording apparatus uses one or more recording heads for jetting ink droplets to form an image. A liquid-jet image forming apparatus is used, for example, for a printer, a facsimile machine, a copier, a plotter, and a multifunction copier having functions of them. Such a liquid-jet image forming apparatus jets liquid droplets from its recording heads onto paper being conveyed ("paper" in the present application is not limited to a sheet of paper but also refers to any medium, such as an OHP sheet, to which ink droplets or other liquid droplets can adhere, and may also be called a recording medium, recording paper, recording sheet, etc.), and thereby forms (records or prints) an image on the paper. There are roughly two types of liquid-jet image forming apparatuses: a serial-type image forming apparatus including a recording head that jets liquid droplets while moving in the main-scanning direction to form an image; and a line-type image forming apparatus including a line-type recording head that remains stationary while jetting liquid droplets to form an image.

In the present application, a liquid-jet image forming apparatus refers to an apparatus that forms an image by jetting a liquid onto a recording medium made of paper, thread, fabric, textile, leather, metal, plastic, glass, wood, ceramic, etc. Also, "image forming" indicates not only a process of forming a meaningful image such as a character or a drawing on a recording medium, but also a process of forming a meaningless image such as a pattern on a recording medium (or just jetting liquid droplets onto a recording medium). Further, in the present application, "ink" refers not only to an ink (colored liquid) in a general sense, but also to any liquid usable for image forming such as a recording liquid, a fixer solution, a DNA specimen, a resist, or a pattern material.

Generally, in a liquid-jet image forming apparatus (hereafter, may also be simply called an inkjet recording apparatus), a cleaning process is performed as needed to remove bubbles and dried ink from nozzles of a recording head and thereby to prevent nozzle clogging. In the cleaning process, a nozzle surface is enclosed (or covered) by a cap, and a space formed by the nozzle surface and the cap is depressurized by a suction pump (suction unit) connected to the cap to forcibly evacuate bubbles and dried ink from nozzles.

After the cleaning process is completed, the suction pump is stopped, the cap is kept over the nozzle surface for a predetermined period of time so that the cap is filled with ink and the negative pressure in the cap is reduced, and then the cap is moved away from the nozzle surface. This makes it possible to prevent a large pressure change from occurring when the cap is moved away.

For example, patent document 1 discloses an inkjet recording apparatus including a pressure pump disposed in a channel connected to an ink cartridge used as a liquid container. The pressure pump forces air into the ink cartridge and thereby pressurizes ink in the ink cartridge. After a head is caused by a suction pump to jet ink into a space in a cap, the pressure pump is driven to apply positive pressure to the ink in the head in the ink-jetting direction and then the cap is moved away from the nozzle surface.

[Patent document 1] Japanese Patent Application Publication No. 2005-225163

Meanwhile, even if a cap is moved away from a nozzle surface after ink is suctioned and the negative pressure in the cap is decreased as described above, ink and bubbles adhering to the nozzle surface may be drawn into nozzle channels because of low residual pressure in the head caused by suction or negative pressure caused by meniscus formation, and may cause nozzle clogging.

Applying positive pressure to ink in a head before moving a cap away from a nozzle surface as in patent document 1 makes it possible to prevent ink and bubbles from being drawn into nozzle channels. However, with the configuration of patent document 1, since an ink cartridge for supplying ink to a recording head is disposed between a pressure pump and the recording head, pressurized residual air remains in the ink cartridge even after the pressure pump is stopped and therefore ink drips off the nozzles of the recording head after the cap is moved away. The dripping ink adheres to the nozzle surface and makes it difficult to clean the nozzle surface even with a wiping part.

SUMMARY OF THE INVENTION

In an aspect of this disclosure, there is provided an image forming apparatus. The image forming apparatus includes a recording head including a nozzle surface having nozzles for jetting droplets of a liquid; a maintenance unit including a cap configured to cap the nozzle surface, a suction unit connected to the cap, and a wiping part configured to wipe the nozzle surface; a liquid container configured to contain the liquid to be supplied to the recording head; a pressure unit configured to pressurize the inside of a supply channel extending from the liquid container to the recording head at a pressurizing position along the supply channel; an opening and closing unit configured to open and close the supply channel at a position downstream of the pressurizing position; and a control unit. The control unit is configured to cap the nozzle surface with the cap and suction the liquid from the nozzles with the suction unit, to move the cap away from the nozzle surface after pressurizing the inside of the supply channel with the pressure unit to a pressure greater than or equal to atmospheric pressure, to wipe the nozzle surface with the wiping part after closing the supply channel with the opening and closing unit, and to open the supply channel with the opening and closing unit after wiping the nozzle surface.

DESCRIPTION OF THE PREFERRED EMBODIMENTS

Figure 1:
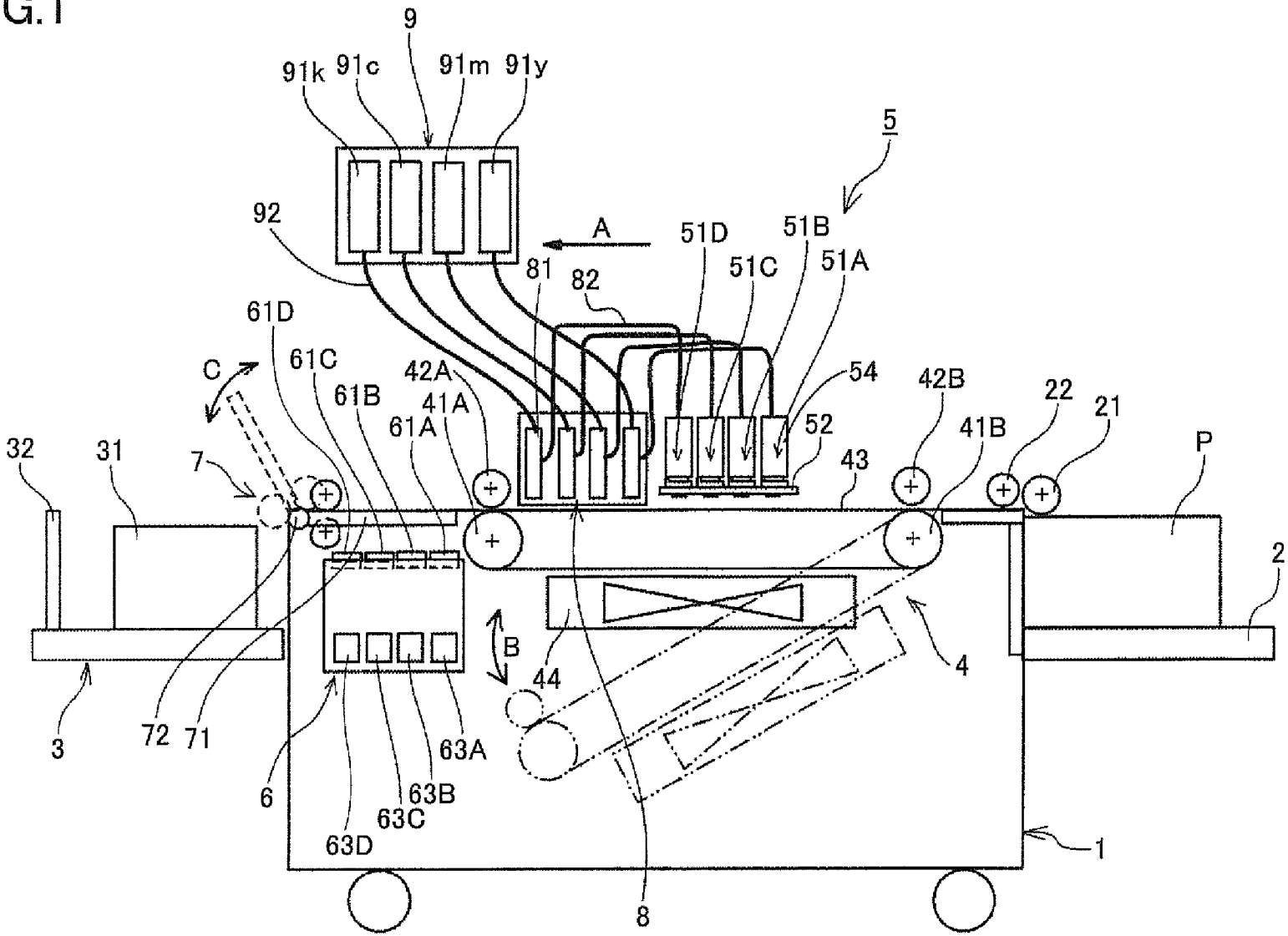
FIG. 1 is an elevational view of an exemplary image forming apparatus according to an embodiment of the present invention.
Figure 2:
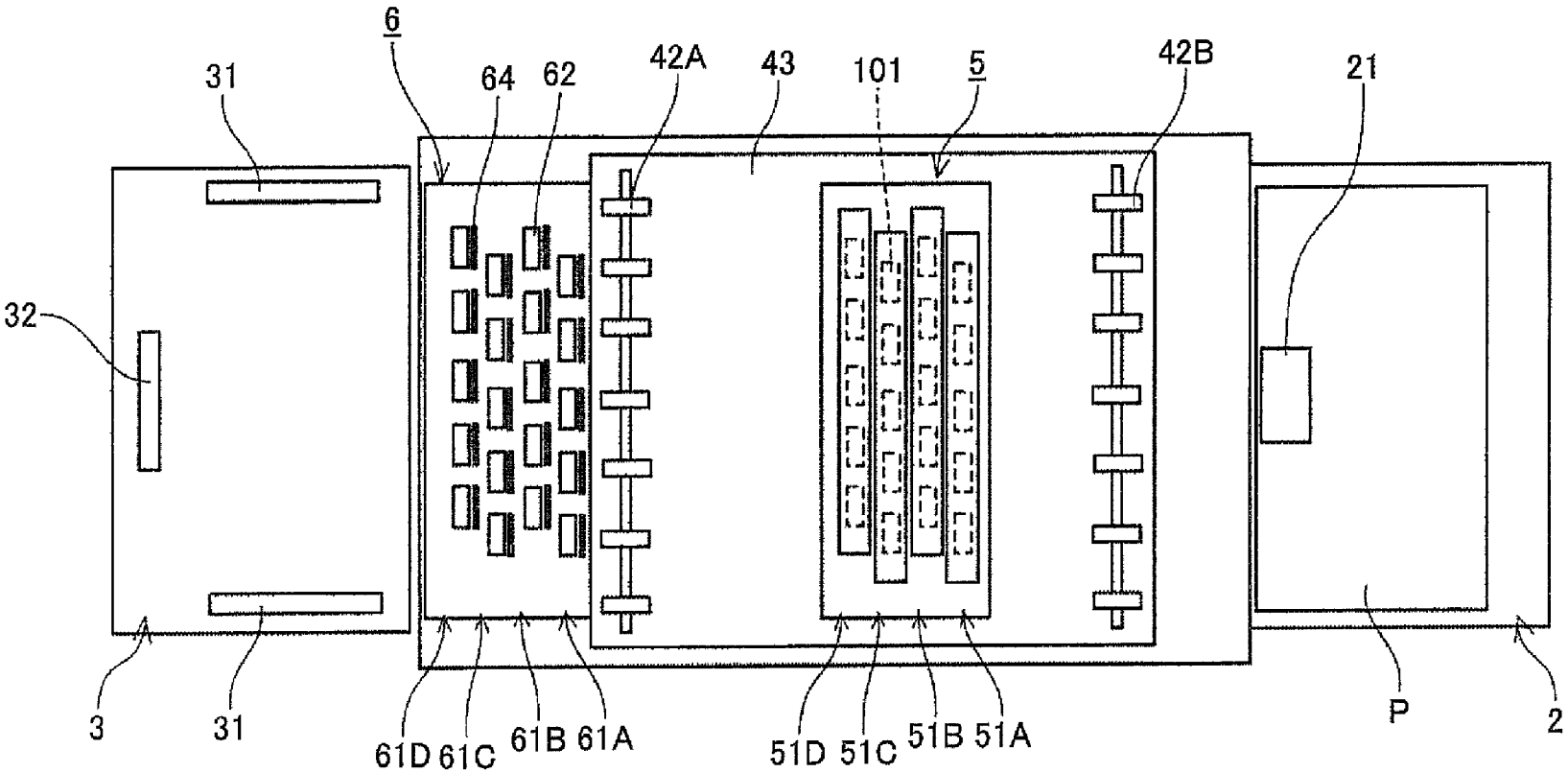
FIG. 2 is a plan view of the image forming apparatus shown in FIG. 1.

Preferred embodiments of the present invention are described below with reference to the accompanying drawings. An exemplary image forming apparatus according to an embodiment of the present invention is described below with reference to FIGS. 1 and 2. FIG. 1 is a schematic diagram illustrating a configuration of the image forming apparatus; and FIG. 2 is a plan view of the image forming apparatus shown in FIG. 1.

The image forming apparatus of this embodiment is a line-type image forming apparatus and includes a main unit 1; a paper-feed tray 2 for holding and feeding paper P; a paper-catch tray 3 for holding the paper P ejected after an image is formed; a conveying unit 4 for conveying the paper P from the paper-feed tray 2 to the paper-catch tray 3; an image forming unit 5 including head modules (recording heads) 51A through 51D for forming an image by jetting liquid droplets onto the paper P being conveyed by the conveying unit 4; a head cleaning unit 6 that is a maintenance (cleaning) mechanism for maintaining the recording heads of the image forming unit 5 after printing is performed or at a given timing; a conveying guide unit 7 for ejecting the paper P onto the paper-catch tray 3 and for opening and closing the head cleaning unit 6; an ink tank unit 8 including sub tanks for supplying ink to the head modules 51 of the image forming unit 5; and a main tank unit 9 for supplying ink to the ink tank unit 8.

The main unit 1 includes front, back, and side boards and a stay (not shown). Sheets of the paper P stacked on the paper-feed tray 2 are fed one by one by a separating roller 21 and a paper-feed roller 22 into the conveying unit 4.

The conveying unit 4 includes a conveyor drive roller 41A, a conveyor driven roller 41B, and an endless conveyor belt 43 stretched over the rollers 41A and 41B. Multiple holes (not shown) are formed in the surface of the conveyor belt 43. A suction fan 44 for attracting the paper P by suction is disposed below the conveyor belt 43. Conveyor guide rollers 42A and 42B are supported by guides (not shown) in positions above the conveyor drive roller 41A and the conveyor driven roller 41B. The conveyor guide rollers 42A and 42B are caused by their own weight to touch the conveyor belt 43.

The conveyor belt 43 rotates as the conveyor drive roller 41A is rotated by a motor (not shown). The paper P is attracted to the conveyor belt 43 by the suction fan 44 and is conveyed by the rotation of the conveyor belt 43. The conveyor driven roller 41B, the conveyor guide roller 42A, and the conveyor guide roller 42B rotate along with the rotation of the conveyor belt 43.

The image forming unit 5 including the head modules 51 for jetting liquid droplets to form an image on the paper P is disposed above the conveying unit 4 and is movable in the direction of an arrow A (and in the opposite direction). The image forming unit 5 is moved to a position above the head cleaning unit 6 when a maintenance (cleaning) process is performed, and is returned to the position shown in FIG. 1 when an image forming process is performed.

Figure 3:
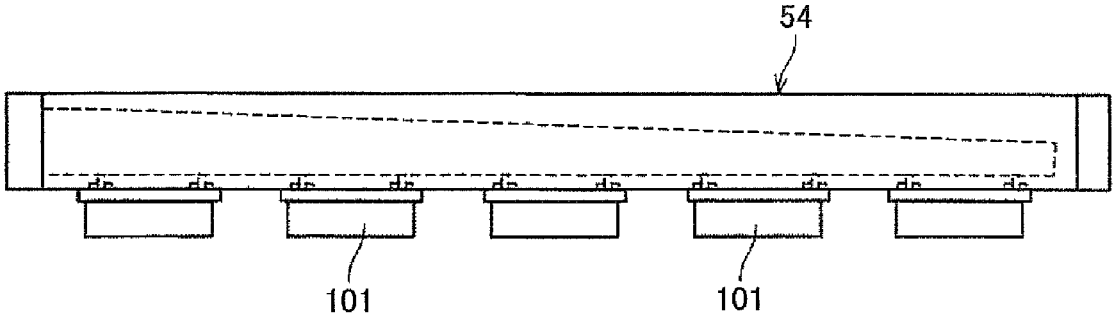
FIG. 3 is a side view of a head module.
Figure 4:
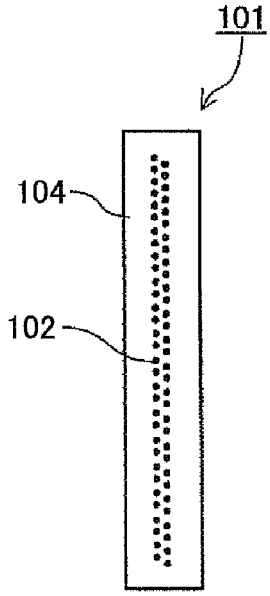
FIG. 4 is a plan view of a head.

The image forming unit 5 also includes a line base part 52. The head modules (recording head units) 51A, 51B, 51C, and 51D are arranged on the line base part 52 along the paper-conveying direction. As shown in FIGS. 3 and 4, each of the head modules 51 includes multiple heads 101 and a branching part 54 for distributing ink to the heads 101. The heads 101 are arranged in a line and fixed to the branching part 54. Each of the heads 101 has a nozzle surface 104 where two arrays of nozzles 102 for jetting liquid droplets are arranged.

In this example, it is assumed that one of the two nozzle arrays of each of the head modules 51A and 51B jets yellow (Y) liquid droplets and the other one of the two nozzle arrays jets magenta (M) liquid droplets; and one of the two nozzle arrays of each of the head modules 51C and 51D jets cyan (C) liquid droplets and the other one of the two nozzle arrays jets black (K) liquid droplets. In other words, in the image forming unit 5, two head modules 51 for jetting liquid droplets of the same colors are arranged next to each other in the paper-conveying direction to form a nozzle array corresponding to a paper width.

Sub-tanks (ink tanks) 81 of the ink tank unit 8 are disposed upstream of the image forming unit 5 and are connected via supply tubes (supply channels) 82 to the head modules 51. Ink is supplied from each sub-tank 81 via the corresponding supply tube 82 to the branching part 54 of the corresponding head module 51. Negative pressure formed by a pressure head difference between the ink tank 81 and the head module 51 is applied to the heads 101 of the head module 51. The ink tank unit 8 is movable in the direction of the arrow A along with the image forming unit 5. In FIG. 1, it appears that the supply tubes 82 extending from the ink tank unit 8 are connected to the upper surfaces of the head modules 51. However, in an actual case, the supply tubes 82 are connected to ends in the longitudinal direction (a direction orthogonal to the paper conveying direction) of the head modules 51.

The main tank unit 9 used as an ink container (or a liquid container) is disposed upstream of the ink tank unit 8. Ink is supplied from main tanks (ink cartridges) 91 of the main tank unit 9 via supply tubes (supply channels) 92 to the sub tanks 81 of the ink tank unit 8.

The conveying guide unit 7 for ejecting the paper P onto the paper-catch tray 3 is disposed downstream of the conveying unit 4. The paper-catch tray 3 includes a pair of side fences 31 for limiting the movement of the paper P in the width direction and an end fence 32 for stopping the leading edge of the paper P.

The maintenance mechanism (head cleaning unit) 6 includes four cleaning units 61A through 61D corresponding to the head modules 51A through 51D of the image forming unit 5. Each of the cleaning units 61 includes a row of caps 62 for capping the nozzle surfaces 104 of the heads 101 of the corresponding head module 51 and a row of wiping parts (wipers) 64 for wiping the nozzle surfaces 104. The rows of the caps 62 of the cleaning units 61 can be moved up and down independent of each other. Suction pumps 63A through 63D used as suction units are also provided below the corresponding cleaning units 61A through 61D. While the nozzle surfaces 104 of the heads 101 are capped by the caps 62, the suction pumps 63A through 63D are driven to suction ink from the nozzles 102.

In a maintenance (cleaning) process of the image forming apparatus of this embodiment, after printing is stopped, the nozzle surfaces 104 of the heads 101 of the head modules 51 are capped by the caps 62 and ink is suctioned from the nozzles 102, and/or the nozzle surfaces 104 are wiped by the wiping parts 64 to remove ink adhering to the nozzle surfaces 104. Before starting the maintenance process after printing is stopped, the conveying unit 4 is swung in the direction of an arrow B around the conveyor driven roller 41B to provide space to allow the image forming unit 5 to move. Also, a conveying guide plate 71 of the conveying guide unit 7 disposed above the head cleaning unit 6 is swung upward around a fulcrum 72 in the direction of an arrow C to clear the space above the head cleaning unit 6.

After the conveying unit 4 and the conveying guide 7 are moved to clear the space, the image forming unit 5 is moved in the paper-conveying direction (arrow A) and stopped above the head cleaning unit 6. Then, the cleaning unit 61 is moved upward and the maintenance (cleaning) process for the head modules 51 is started.

Figure 5:
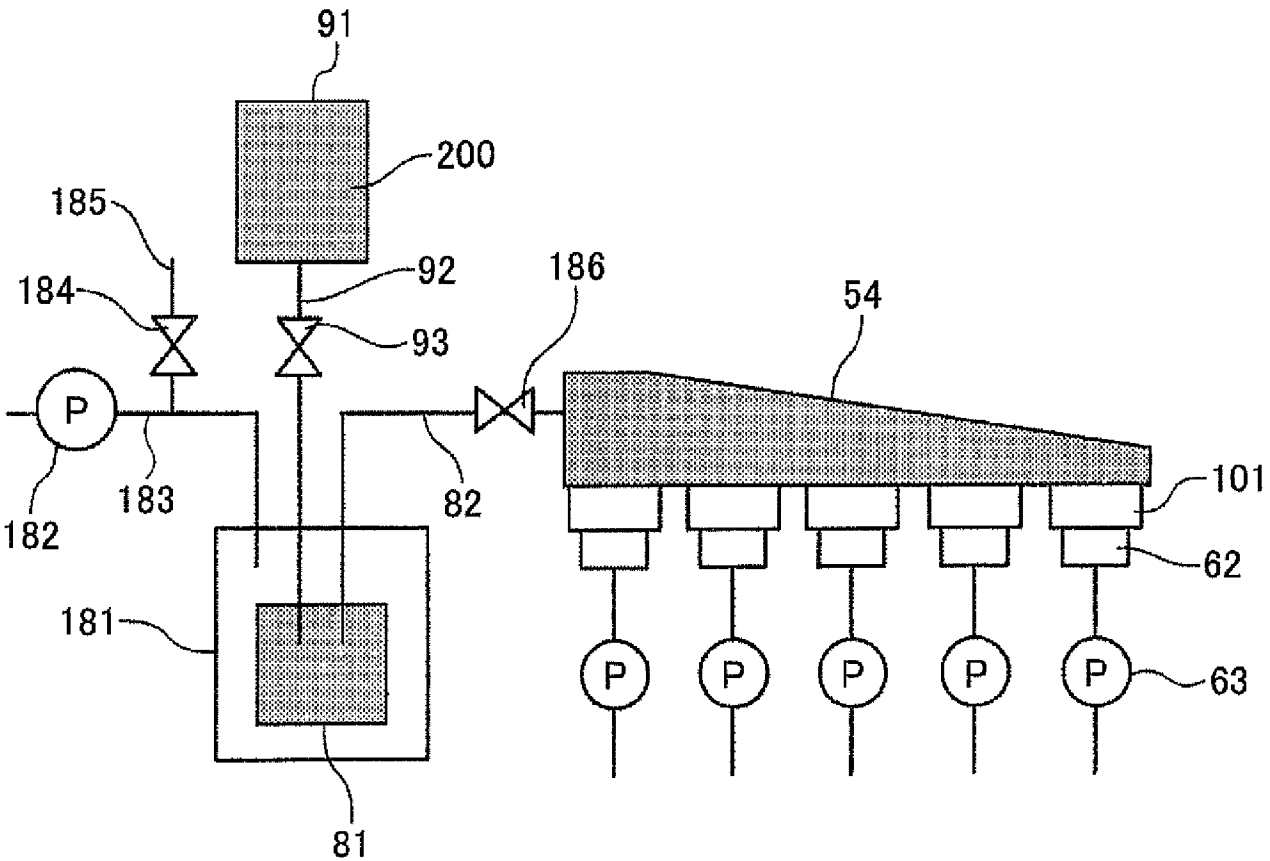
FIG. 5 is a schematic diagram illustrating an ink supply system according to a first embodiment of the present invention.

Next, a first embodiment of the present invention is described below. Hereafter, components of the same type (e.g., the sub tanks 81) may be referred to in the singular form (e.g., the sub tank 81) for descriptive purposes. FIG. 5 is a schematic diagram illustrating an ink supply system according to the first embodiment of the present invention. The sub tank (ink tank) 81 has a sealed structure (therefore, the sub tank 81 may be called a sealed sub tank) and is made at least partially of a flexible material such as a flexible film. The sub tank 81 contains ink 200 to be supplied to the heads 101 of the head module 51 and is positioned such that a pressure head difference is generated between the sub tank 81 and the heads 101 of the head module 51. The ink 200 is supplied from the main tank (ink cartridge) 91 replaceably attached to the main tank unit 9 via the supply channel (supply tube) 92 to the sub tank 81. An ink supply valve 93, which is a normally-closed valve, is interposed between the supply channel 92 and the sub tank 81.

The sub tank 81 is housed in a pressure case 181 used as a sub tank housing. A pressure pump 182, which is a pressure unit implemented, for example, by a tube pump, supplies air into the pressure case 181 to pressurize the sub tank 81 and thereby to pressurize the inside of a supply channel extending from the main tank 91 to the head module 51. An atmosphere opening channel 185 branches from an air supply channel 183 extending from the pressure pump 182 to the pressure case 181. The atmosphere opening channel 185 opens the air supply channel 183 to the atmosphere. An atmosphere opening valve 184, which is a normally-open valve, is provided at a position along the atmosphere opening channel 185.

Meanwhile, a supply channel shutoff valve (opening and closing unit) 186 is provided at a position along the supply channel (supply tube) 82 extending from the sub tank 81 to the branching part 54 to open and close the supply channel 82. The supply channel shutoff valve 186 is a normally-open valve and therefore the supply channel 82 is normally open.

In the ink supply system configured as described above, the ink 200 is supplied from the main tank 91 to the sealed sub tank 81 by means of the pressure head difference; the amount of the ink 200 in the sub tank 81 is detected by a part (not shown) that is displaced or deformed by the deformation of the flexible film (flexible material) of the sub tank 81; the ink supply valve 93 is controlled (opened and closed) to control the supply of the ink 200 from the main tank 91 to the sub tank 81 and thereby to keep the amount of the ink 200 in the sub tank 81 at a predetermined level.

Meanwhile, the ink 200 is supplied from the sub tank 81 to the heads 101 of the head module 51 by using a natural phenomenon, i.e., the pressure head difference between the nozzle surfaces 104 of the heads 101 and the upper surface of the sub tank 81.

Figure 6:
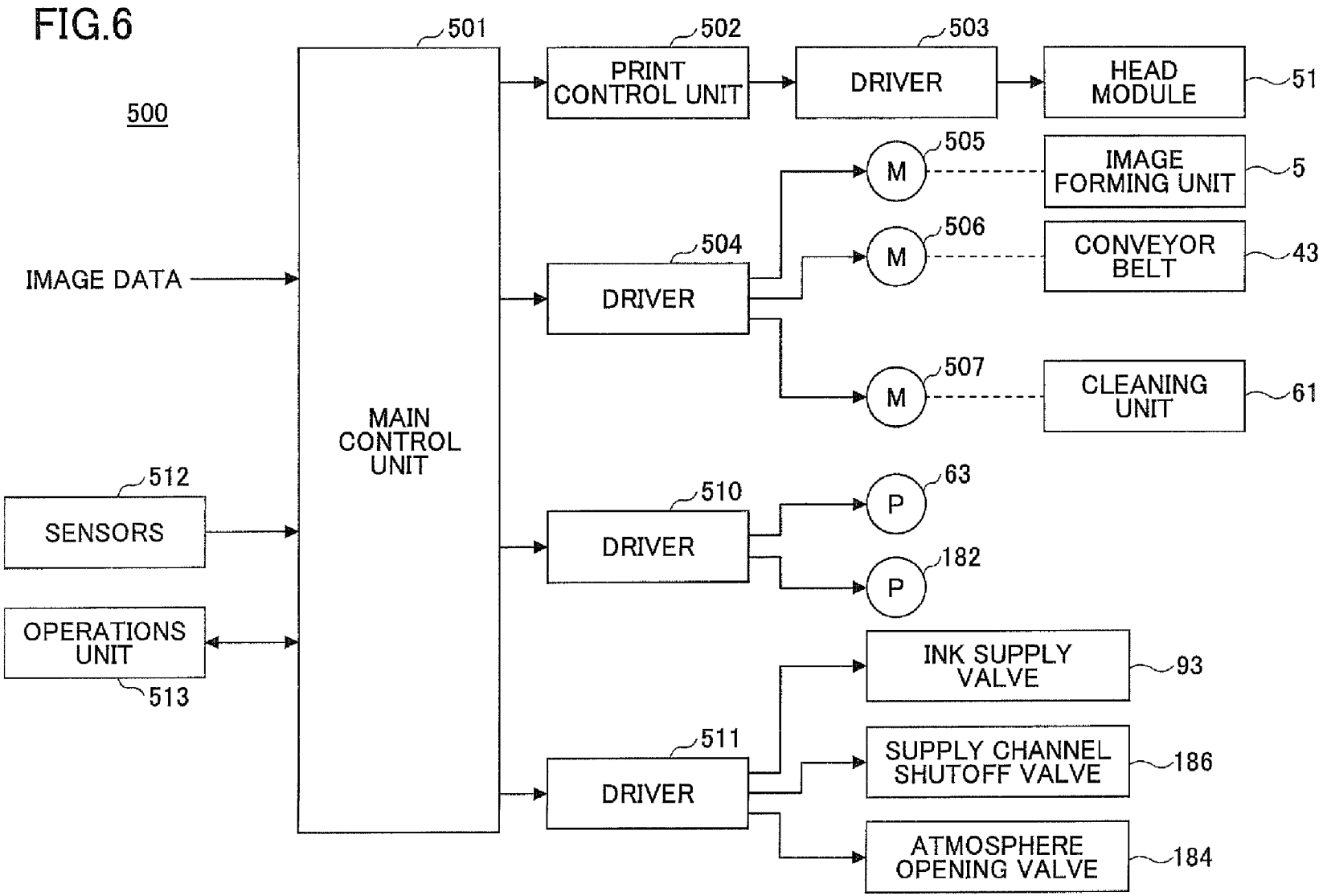
FIG. 6 is a block diagram illustrating a control unit.

Next, a control unit 500 of the image forming apparatus of this embodiment is described below with reference to a block diagram of FIG. 6.

The control unit 500 includes a main control unit (system controller) 501 for controlling the entire image forming apparatus and a maintenance (cleaning) process according to embodiments of the present invention. The main control unit 501 includes a microcomputer, an image memory, and a communication interface. The main control unit 501 sends print data (signal) to a print control unit 502 to form an image on paper based on image data and commands transferred from, for example, an external information processing apparatus (host).

The print control unit 502 generates data for driving a pressure generator(s) for causing the heads 101 of the head module (recording head) 51 to jet liquid droplets based on the print data signal received from the main control unit 501, and sends signals necessary for the transmission and the transmission control of the generated data to a head driver 503. The print control unit 502 includes a storage unit for storing drive waveform data; a drive waveform generating unit including a D/A converter for converting the drive waveform data from digital to analog, a voltage amplifier, and a current amplifier; and a drive waveform selecting unit for selecting a drive waveform to be supplied to the head driver 503. The print control unit 502 generates a drive waveform made up of one or more drive pulses (drive signals), and outputs the drive waveform to the head driver 503 to control the head module 51.

The main control unit 501 also controls, via a motor driver 504, a unit moving motor 505 for moving the image forming unit 5 between an image forming position and a maintenance (cleaning) position, a paper-feed motor 506 for rotating the conveyor belt 43, a fan motor (not shown) for rotating the suction fan 44, and a maintenance motor 507 for moving the cleaning unit 61 up and down.

Also, the main control unit 501 controls, via a driver 510, the suction pump 63 of the head cleaning unit 6 and the pressure pump 182 for pressurizing the inside of a supply channel; and controls (opens and closes), via a driver 511, the ink supply valve 93, the supply channel shutoff valve 186, and the atmosphere opening valve 184 for opening the air supply channel 183 extending from the pressure pump 182 to the atmosphere.

Further, the main control unit 501 receives detection signals from sensors 512, and sends and receives information such as display information to and from an operations unit 513.

Next, a maintenance (cleaning) process of this embodiment is described with reference to a timing chart of FIG. 7.

As described above, before a maintenance (cleaning) process is performed for the heads 101 of the head module 51, the unit moving motor 505 is driven to move the image forming unit 5 to a position above the head cleaning unit 6. Then, the maintenance motor 507 is driven to move the cleaning unit 61 upward and thereby to cap the nozzle surfaces 104 of the heads 101 with the caps 62 as shown in FIG. 5.

Figure 7:
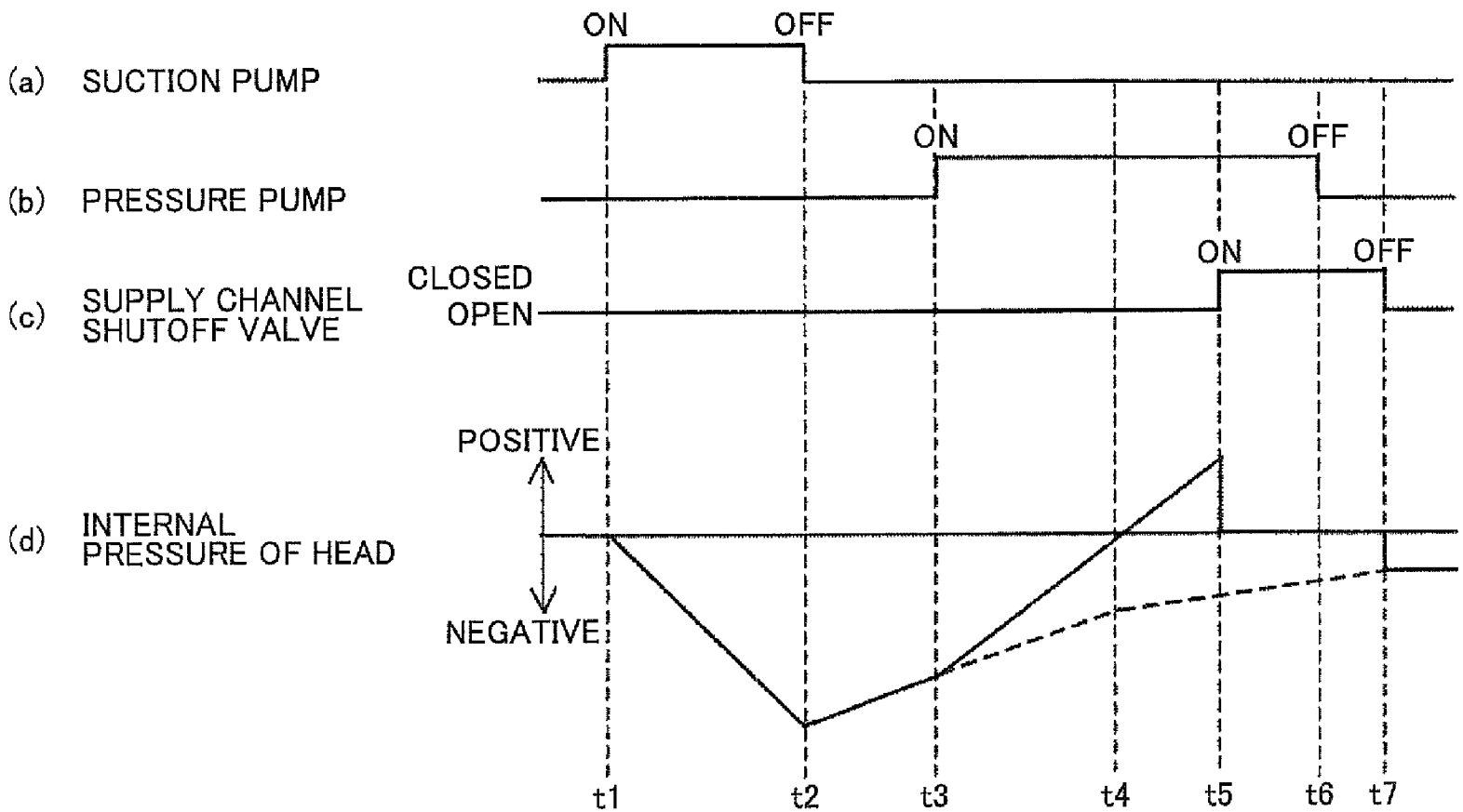
FIG. 7 is a timing chart used to describe a maintenance process according to the first embodiment.

After that, as shown by FIG. 7 (*a*), the suction pump 63 is turned on at time t1 to generate negative pressure in spaces formed between the nozzle surfaces 104 of the heads 101 and the caps 62 and thereby to suction ink from the nozzles 102. Accordingly, as shown by FIG. 7 (*d*), the internal pressure of the heads 101 becomes negative. After suctioning ink (bubbles and dried ink) from the nozzles 102, the suction pump 63 is turned off at time t2. As a result, the negative pressure in the spaces decreases (i.e., the pressure increases) and the internal pressure of the heads 101 also increases gradually toward atmospheric pressure.

At time t3, the pressure pump 182 is turned on to pressurize the sub tank 81. As a result, the inside of the supply channel 82 extending from the sub tank 81 to the heads 101 of the head module 51 is pressurized and the inside of the heads 101 are positively pressurized. This in turn causes the internal pressure of the heads 101 to increase faster than when no pressure is applied to the heads 101. In this example, the internal pressure of the heads 101 reaches atmospheric pressure at time t4 and then becomes positive. After the internal pressure of the heads 101 reaches atmospheric pressure at time t4, the caps 62 are started to be moved away from the nozzle surfaces 104. By the way, when the pressure pump 182 is turned on, the atmosphere opening valve 184 is closed.

Moving a cap away from a nozzle surface while applying positive pressure to the inside of a head as described above makes it possible to prevent a problem where ink and bubbles adhering to the nozzle surface are drawn into the nozzles after the cap is moved away because of low residual pressure in the head caused by suction or of negative pressure caused by meniscus formation, and thereby makes it possible to prevent nozzle clogging.

At time t5, the supply channel shutoff valve 186 is closed (turned on) to close the supply channel 82 and thereby to stop pressurizing the inside of the heads 101. As a result, the pressure in the heads 101 returns to atmospheric pressure. After the pressure pump 182 is turned off at t6, the wiping parts 64 are moved upward and the image forming unit 5 is moved with respect to the wiping parts 64 to wipe the nozzle surfaces 104. After the wiping is completed, the supply channel shutoff valve 186 is opened (turned off) at time t7 to open the supply channel 82 extending from the sub tank 81 to the head module 51.

Shutting off the pressure being applied to a head by closing a supply channel with a supply channel shutoff valve and thereby causing the internal pressure in the head to return to atmospheric pressure as described above makes it possible to prevent ink from dripping off the nozzles due to the residual positive pressure after the cap is moved away. This in turn makes it possible to sufficiently clean a nozzle surface with a wiping part.

Figure 8:
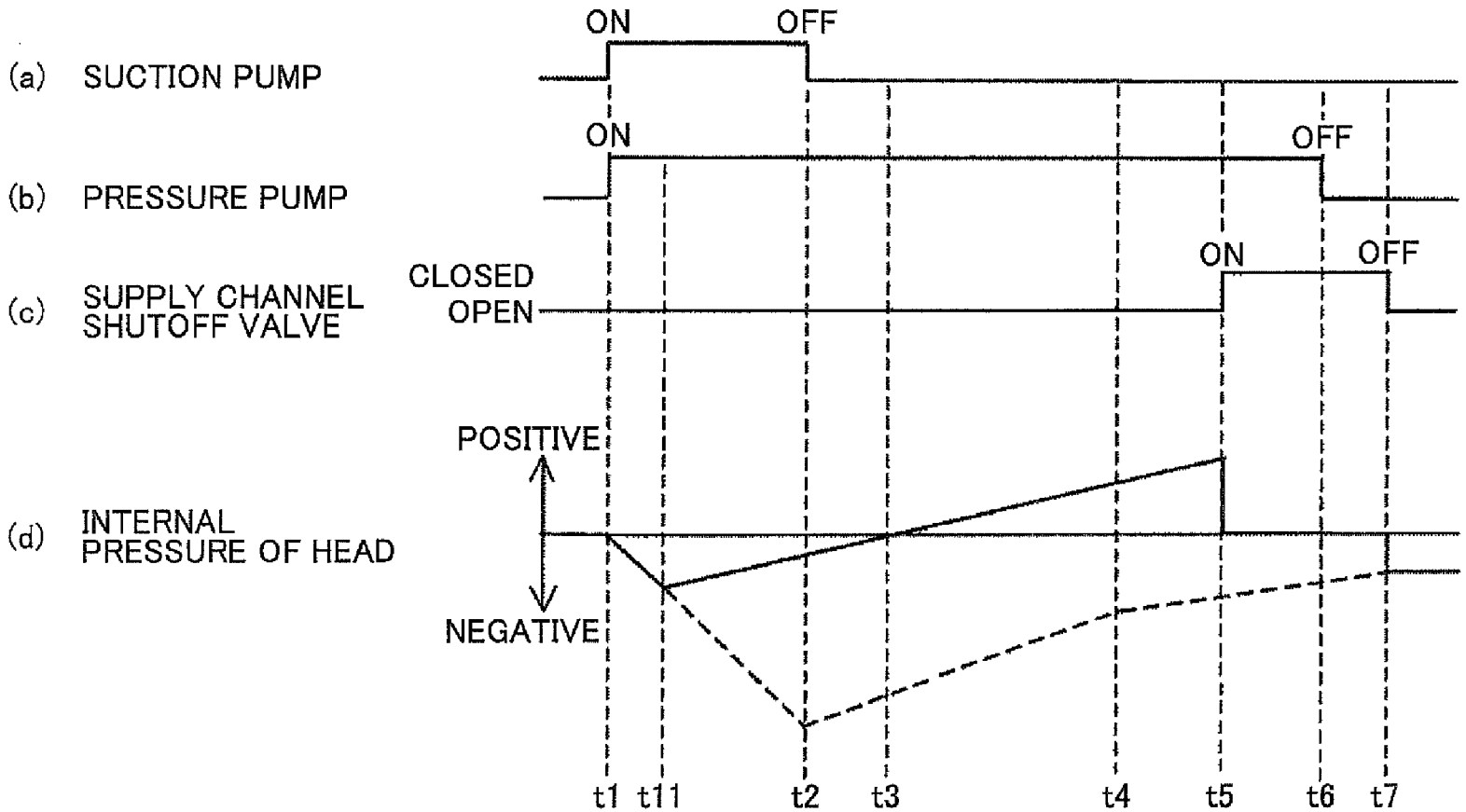
FIG. 8 is a timing chart used to describe a maintenance process according to a second embodiment of the present invention.

A second embodiment of the present invention is described below with reference to a timing chart of FIG. 8.

In this embodiment, the suction pump 63 is turned on at time t1 to start suctioning ink (bubbles and dried ink) from the nozzles 102 and at the same time, the pressure pump 182 is turned on to start applying pressure to the inside of the heads 101.

Performing a suction process and a pressurizing process concurrently as described above makes it possible to increase the flow velocity in the heads 101 and thereby to more effectively eject bubbles and dried ink from the nozzles.

Figure 9:
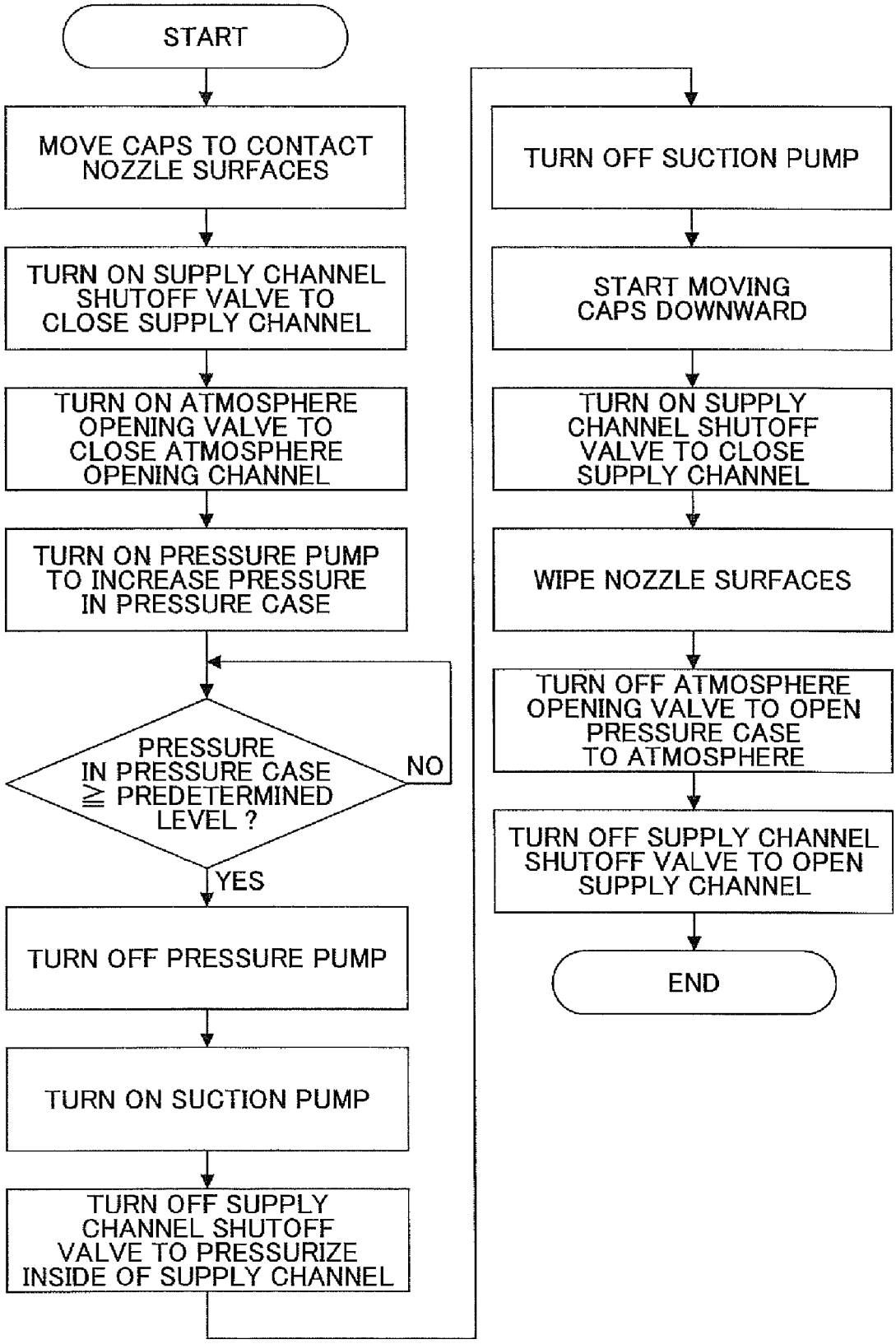
FIG. 9 is a flowchart showing a maintenance process according to a third embodiment of the present invention.
Figure 10:
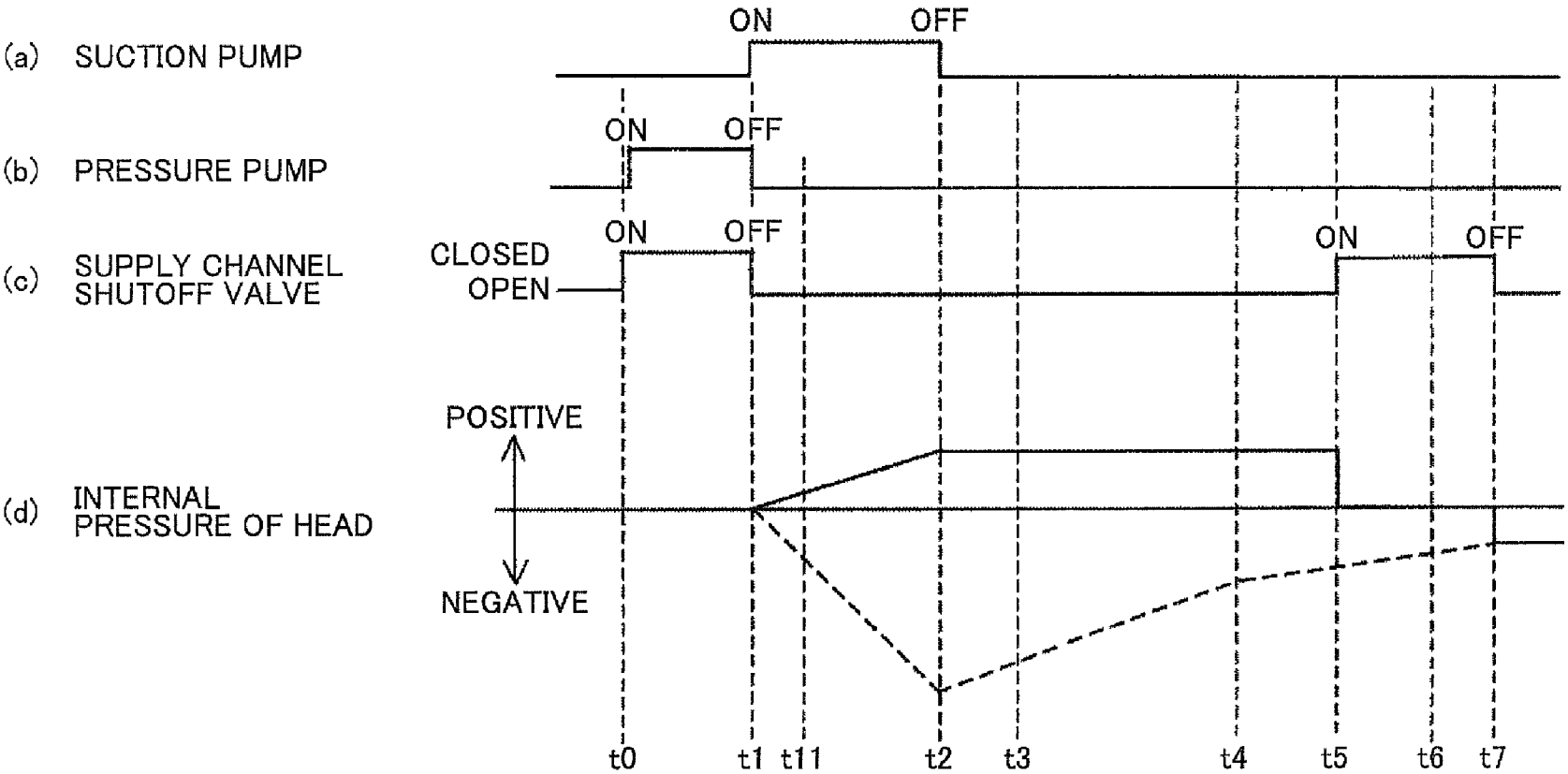
FIG. 10 is a timing chart used to describe the maintenance process according to the third embodiment.

A maintenance (cleaning) process according to a third embodiment of the present invention is described below with reference to a flowchart of FIG. 9 and a timing chart of FIG. 10.

In the maintenance process of the third embodiment, the caps 62 are moved upward to contact the nozzle surfaces 104 of the heads 101, the supply channel shutoff valve 186 is closed (turned on) to close the supply channel 82, and the atmosphere opening valve 184 is closed (turned on) to close the atmosphere opening channel 185 for opening the air supply channel 183 to the atmosphere. Next, the pressure pump 182 is turned on to supply air into the pressure case 181 to increase the pressure in the pressure case 181. When the pressure in the pressure case 181 reaches a predetermined level, the pressure pump 182 is turned off.

Then, the suction pump 63 is turned on and the supply channel shutoff valve 186 is opened (turned off) to open the supply channel 82. As a result, the inside of the supply channel 82 is pressurized and the inside of the heads 101 is positively pressurized. After a predetermined period of time (or after a predetermined amount of ink is suctioned), the suction pump 63 is turned off and then the caps 62 are started to be moved downward. Next, after the supply channel shutoff valve 186 is closed (turned on) to close the supply channel 82 and thereby to stop pressurizing the heads 101, the nozzle surfaces 104 are wiped with the wiping parts 84.

Then, the atmosphere open valve 184 is opened to open the pressure case 181 to the atmosphere (i.e., to release the positive pressure in the pressure case 181) and the supply channel shutoff valve 186 is opened (turned off) to open the supply channel 82.

This configuration makes it possible to start applying positive pressure to the inside of a head at substantially the same time as starting to suction ink from the nozzles.

The above embodiments are described using a line-type image forming apparatus as an example. However, the present invention may also be applied to a serial-type image forming apparatus.

An aspect of the present invention makes it possible to prevent nozzle clogging as well as to prevent ink from dripping off nozzles after a cap is moved away from a nozzle surface.

According to an aspect of the present invention, an image forming apparatus includes a suction unit; a pressure unit configured to pressurize the inside of a supply channel extending from a liquid container to a recording head at a pressurizing position along the supply channel; an opening and closing unit configured to open and close the supply channel at a position downstream of the pressurizing position; and a control unit configured to cap a nozzle surface with a cap and suction ink from nozzles with the suction unit, to move the cap away from the nozzle surface after pressurizing the inside of the supply channel with the pressure unit to a pressure greater than or equal to atmospheric pressure, to wipe the nozzle surface with a wiping part after closing the supply channel with the opening and closing unit, and to open the supply channel with the opening and closing unit after wiping the nozzle surface. This configuration makes it possible to prevent ink and bubbles adhering to the nozzle surface from being drawn into the nozzles after the cap is moved away. Also, it is possible to prevent ink from dripping off the nozzles by stopping application of pressure to the recording head by closing the supply channel with the opening and closing unit after the cap is moved away.

The present invention is not limited to the specifically disclosed embodiments, and variations and modifications may be made without departing from the scope of the present invention.

The present application is based on Japanese Priority Application No. 2009-007285, filed on Jan. 16, 2009, the entire contents of which are hereby incorporated herein by reference.

What is claimed is:

1. An image forming apparatus, comprising:

a recording head including a nozzle surface having nozzles for jetting droplets of a liquid;

a maintenance unit including a cap configured to cap the nozzle surface, a suction unit connected to the cap, and a wiping part configured to wipe the nozzle surface;

a liquid container configured to contain the liquid to be supplied to the recording head;

a pressure unit configured to pressurize an inside of a supply channel extending from the liquid container to the recording head at a pressurizing position along the supply channel;

an opening and closing unit configured to open and close the supply channel at a position downstream of the pressurizing position;

a control unit configured to cap the nozzle surface with the cap and suction the liquid from the nozzles with the suction unit, to move the cap away from the nozzle surface after pressurizing the inside of the supply channel with the pressure unit to a pressure greater than or equal to atmospheric pressure, to wipe the nozzle surface with the wiping part after closing the supply channel with the opening and closing unit, and to open the supply channel with the opening and closing unit after wiping the nozzle surface;

a sub tank disposed at a position along the supply channel and made at least partially of a flexible material; and a sub tank housing configured to house the sub tank, wherein the pressure unit is configured to supply air into the sub tank housing to pressurize the sub tank and thereby to pressurize the inside of the supply channel.

2. The image forming apparatus as claimed in claim 1, wherein the control unit is configured to start pressurizing the inside of the supply channel with the pressure unit after turning off the suction unit.

3. The image forming apparatus as claimed in claim 1, wherein the control unit is configured to pressurize the inside of the supply channel with the pressure unit concurrently with suctioning the liquid from the nozzles with the suction unit.

4. The image forming apparatus as claimed in claim 1, wherein the control unit is configured to start suctioning the liquid from the nozzles with the suction unit after closing the supply channel with the opening and closing unit and pressurizing the inside of the supply channel with the pressure unit to a predetermined pressure; and to stop suctioning the liquid from the nozzles and start moving the cap away from the nozzle surface after pressurizing an inside of the recording head by opening the supply channel with the opening and closing unit.

* * * * *